US005509223A

United States Patent [19]

Jung

[11] Patent Number: 5,509,223

[45] Date of Patent: Apr. 23, 1996

[54] LIGHTING SYSTEM

[75] Inventor: Hae-Ryong Jung, Lanham, Md.

[73] Assignee: Shenandoah Creations Co., Inc., Lanham, Md.

[21] Appl. No.: 250,118

[22] Filed: May 26, 1994

Related U.S. Application Data

[63] Continuation of Ser. No. 963,627, Oct. 20, 1992, abandoned.

[51] Int. Cl.[6] ..... G09F 13/04

[52] U.S. Cl. ..... 40/564; 362/297

[58] Field of Search ..... 40/545, 564, 575, 40/581; 362/217, 223, 260, 297, 320, 376

[56] References Cited

U.S. PATENT DOCUMENTS

| | | | |
|---|---|---|---|
| 871,510 | 11/1907 | Kerr | 40/575 |
| 2,269,718 | 1/1942 | Huber | 40/564 |
| 2,341,658 | 2/1944 | Salani | 362/297 |
| 4,383,382 | 5/1983 | Hegarty | 40/545 |
| 4,642,741 | 2/1987 | Cohn | 362/320 |
| 4,683,525 | 7/1987 | Camm | 362/297 X |
| 4,794,503 | 12/1988 | Wooten et al. | 362/297 X |
| 4,864,475 | 9/1989 | Jung | 40/581 X |
| 4,991,070 | 2/1991 | Stob | 362/223 |
| 5,075,827 | 12/1991 | Smith | 362/221 |
| 5,192,129 | 3/1993 | Figueroa | 362/260 X |
| 5,235,499 | 8/1993 | Bertenshaw | 362/297 |

*Primary Examiner*—Brian K. Green
*Attorney, Agent, or Firm*—Morton J. Rosenberg; David I. Klein

[57] ABSTRACT

A lighting system (10) is provided to allow a plurality of overlapping virtual images (16–16''') to be viewed by an external observer. Lighting mechanisms (18) are positionally located adjacent reflectors (20) to form virtual images (16–16''') and provide a wide solid band of lighting to be viewed by the observer. Housings (32 and 32') enclose the combination of the light mechanism (18) and reflectors (20) and a sign member (12) is formed on a frontal wall for viewing of particular indicia (14) formed on or through sign member (12). Reflector (20) may be bonded to a reflector support (38) fixedly mounted within housing (32). A color transmissive housing may be mounted over light mechanism (18) to provide a particular color to be passed external to housings (32 and 32'). In this manner, the external observer is provided with a substantially constant illumination density for light emission from light mechanism (18) passing through a sign member (12).

8 Claims, 6 Drawing Sheets

LIGHTING SYSTEM

This is a continuation of application Ser. No. 07/963,627 filed on 20 October 1992, now abandoned, which is a Continuation-in-Part of U.S. patent application Ser. No. 07/865,222 filed 8 April 1992.

BACKGROUND OF THE INVENTION

1. Field of the Invention

This invention relates to lighting systems which provides a substantially wide constant illumination intensity when observed by an external viewer. This invention relates to a lighting system which may be used as a luminaire or lighting fixture as well as a lighting system which is applicable for sign members. More in particular, this invention relates to a lighting system which provides for a plurality or multiplicity of virtual images which are overlapping as viewed by an external viewer to produce a wide substantially constant illumination band which is useful in lighting fixtures, luminaires and sign members. Still further, this invention pertains to a lighting system where a lighting mechanism is used in combination with a reflector having the lighting mechanism mounted adjacent a concavely contoured reflector for producing overlapping virtual images of the lighting mechanism. Still further, this invention relates to a lighting system where the lighting mechanism is positionally located between either a focal point or the center of a radius of the concavely contoured reflector to provide the multiplicity and overlapping virtual images viewed by an external observer. Additionally, this invention pertains to a lighting system which includes a substantially circular contoured and concavely directed reflector in combination with a lighting system which may be a fluorescent or neon tube. More in particular, this invention relates to a lighting system where the tubular light source is mounted between either a focal point or a center of a radius of a reflector. More in particular, this invention directs itself to a lighting system where a tubular light source is mounted within a circular cross-sectional tubular housing. Still further, this invention pertains to a lighting system which provides for a tubular lighting source mounted adjacent a reflector surface which in itself is secured to an inner wall of a substantially transparent tubular housing, More in particular, this invention pertains to a lighting system where a tubular light source is mounted adjacent a reflector which is mounted to a substantially transparent wall of an outer tubular housing. More in particular, this invention directs itself to a lighting system where a tubular light source is used in combination with a reflector mounted to a transparent tubular housing wall formed of a polycarbonate composition. Still further, this invention relates to a lighting system where the lighting system may be used as a sign mechanism with a linear tubular light source and a linear circularly contoured concave mirror grade reflector provides an enlarged and distorted virtual image of the light source by an external observer.

2. Prior Art

Lighting systems are well known in the prior art. The best prior art known to the Applicant includes U.S. Pat. Nos. 4,642,741; 4,864,475; 1,858,755; 3,194,958; 4,991,070; 3,586,849; 4,383,382; and, 871,510.

In some prior art systems such as that shown in U.S. Pat. No. 4,642,741, there are provided fluorescent lighting systems which includes a reflector and a fluorescent tube in proximity each to the other. However, in such prior art systems collars are provided which fixedly secure the fluorescent tubes to the reflector surfaces. In such prior art systems the reflectors direct themselves to providing a substantially parallel light emission. Such prior art systems do not provide for overlapping virtual images to be viewed by an external viewer.

Other lighting systems such as that shown in U.S. Pat. No. 4,864,475 direct themselves to light box systems which utilize a plurality of tubular light sources however, such prior art systems do not provide for the substantially concavely contoured reflectors in combination with the predetermined position of the tubular members to provide the overlapping and intersecting virtual images viewable to an external observer.

Other prior art systems such as that shown in U.S. Pat. No. 1,858,755 provide for the mounting of tubular light sources within light boxes however, such prior art systems do not provide for the reflector contour in a concave manner for overlapping virtual image production as is provided in the subject invention system.

Still other prior art systems such as that shown in U.S. Pat. No. 3,194,958 provide for mounting of a plurality of fluorescent light sources in combination with reflectors however, such do not provide for a particular reflector contour in combination with a positionally located light source to provide overlapping of virtual images Other prior art lighting systems provide sleeves for diffusing light from a lighting fixture such as that shown in U.S. Pat. No. 4,991,070. Such sleeves are adapted to telescopically receive a lighting element such as a fluorescent tube however, such provides for a lens to be incorporated therein for diffusing the light emitted and does not provide for the concept or elements associated with the virtual image overlapping considerations of the subject Patent Application concept. In such prior art systems there are a multiplicity of angled surfaces used to diffuse and reflect light which are formed with a smooth interior surface which allows for the reflecting member to be mounted or secured only in a particular area of the overall sleeve.

Other prior art systems such as that shown in U.S. Pat. No. 871,510 direct themselves to light boxes which include sign members which may be slideably inserted in the light box. However, such prior art systems do not provide for the combination of elements which allow for overlapping and intersecting virtual images which provide for the illumination of the subject concept.

Still other prior art systems direct themselves to sign members having a plurality of fluorescent bulbs generally mounted within parabolically contoured reflectors. Once again, such systems generally provide for parallel light beams being exited from the fixture which does not allow for the intersecting of virtual images produced by the combination of elements of the subject invention system.

SUMMARY OF THE INVENTION

A lighting system is provided which includes a light mechanism for emitting electromagnetic radiation within the visible bandwidth. A reflector member is included which has a concavely contoured envelope with the light mechanism positionally located adjacent an inner reflecting surface of the reflector member for producing a plurality of intersecting virtual images of the light mechanism. A housing is provided for substantially encompassing the light mechanism and the reflector member with the housing defining a rear section for mounting or securement of the reflector member therein.

An object of the subject invention concept is to provide a lighting system which provides an external viewer with overlapping and intersecting virtual images of a light mechanism and can be used as a lighting fixture, luminaire or as the basic lighting concept for a sign.

In particular, the subject invention concept when used within a light box for a sign provides a continuous virtual image which forms an enlarged but distorted continuous virtual image of the light mechanism or light source.

Another object of the invention is to provide a lighting system which establishes a luminaire or lighting fixture having a substantially even distribution of the light intensity and brightness over an external area being lighted.

DESCRIPTION OF THE PREFERRED EMBODIMENTS

Referring now to FIGS. 1–13, there is shown lighting system 10 for use in both domestic and commercial lighting conditions. Lighting system 10 as will be described in following paragraphs may be used as a light fixture or in the alternative be provided with sign member 12 having indicia 14 formed thereon or cut out to provide a meaningful visual observation to an external viewer.

The preferred embodiment of lighting system 10 is for use as a lighting fixture or luminaire as provided and shown in FIGS. 6–8 and 12–13. Additionally, lighting system 10 can be used as a sign illumination system as shown in FIGS. 3, 4 and 10–11.

Figure 1:
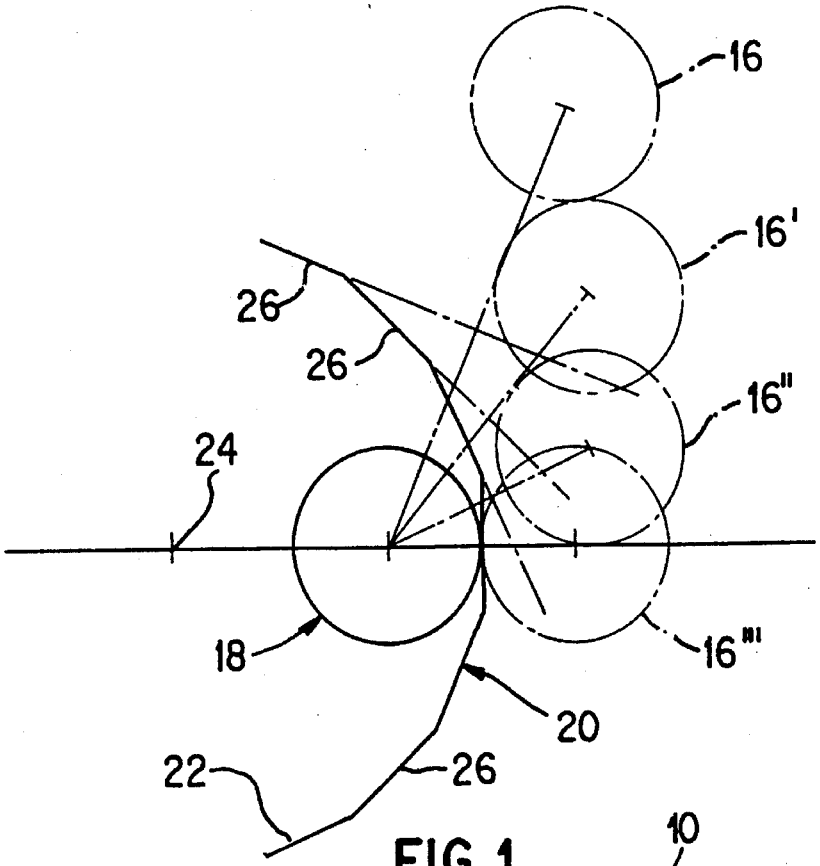
FIG. 1 is a schematic view of the subject lighting system invention concept establishing overlapping virtual images from a light source.

The overall concept of lighting system 10 is to present to an external viewer a plurality of overlapping and interfacing virtual images 16, 16', 16" and 16''' derived from light mechanism 18 as shown schematically in FIG. 1. In this manner, there is provided to an external viewer an enlarged virtual overall image of light 18 being reflected forward of lighting system 10. With the concept of the overlapping and interfacing virtual images from light 18, the observer is given a wider illumination area from a singular light mechanism 18 and such provides for a wider area to view indicia 14 when sign member 12 is being utilized in overall lighting system 10. Additionally, with the concept of the overlapping virtual images 16–16''', the intensity over an arcuate area viewed by an external viewer is lessened in the variation of the illumination to provide the external viewer with a somewhat more constant illumination intensity than that known in the prior art.

Referring now to FIG. 1, there is shown a schematic diagram of the overall lighting system concept which includes light mechanism 18 for emitting electromagnetic energy radiation within the visible bandwidth. Light mechanism 18 may be an incandescent lamp, a neon tube or a fluorescent tube as will be discussed in following paragraphs. Light mechanism 18 is mounted or positionally located adjacent reflector 20 and in particular is located near inner reflecting surface 22 of reflector 20.

Reflector 20 has a concavely contoured envelope as is seen in FIGS. 1, 2, 6 and 7. As shown in FIG. 1, reflector 20 has an envelope which forms a substantially circular contour having a center point 24. By placement of light mechanism 18 between center point 24 and inner reflecting surface 22 of reflector 20, a plurality of virtual images 16–16''' is observable by a viewer external to lighting system 10.

Reflector 20 may be formed in a parabolic cross-sectional contour and in this case, lighting mechanism 18 is positionally located between a focal point (represented by center point 24 for a circular reflector) and inner surface 22 of reflector member 20. In this manner, when a parabolic contour is utilized for lighting system 10, the light transmitted from light mechanism 18 will not produce a parallel external path for light being observed by the user but will produce virtual images such as that schematically shown in FIG. 1.

Reflector 20 may be formed of a plurality of linearly directed planar reflecting elements 26 as is shown however, as in all cases the envelope produced by the reflector 20 should be concave for the observable virtual images 16–16''' to be observed.

Alternatively, reflector 20 may be formed in a concavely contoured envelope which is formed in a continuous geometric contour as is seen in FIGS. 2, 4, 10 and 11. Reflector 20 may be formed of a mirror grade concave reflector composition such as polished aluminum or some like mirror type coating not important to the inventive concept as herein described with the exception that it have a high reflectance.

As is seen in FIG. 1, there is provided a substantially continuous and expanded light strip band over that which would be obtained by a parallel emission of light from reflector 20. As is evident, and in additional to the primary virtual images formed by a singular reflection, there are provided secondary and tertiary virtual images formed by a plurality of reflections on elemental plate elements 26 as shown in FIG. 1 subsequent to light being emitted from light mechanism 18.

It has been found that when the diameter of the concave reflector 20 is approximately three times larger with respect to the diameter of a linear tubular light mechanism 18, a full width of the expanded lighted band strip on inner surface 22 of reflector 20 is observed by a viewer which essentially provides the observer with three times the width of a substantially constant light illumination.

As is seen in FIGS. 2, 4, 7, 8 and 11, the overall and basic concept for lighting system 10 may be incorporated into a system having a plurality of lighting mechanisms 18 and reflectors 20 to expand the light band illumination observable by a viewer.

Figure 2:
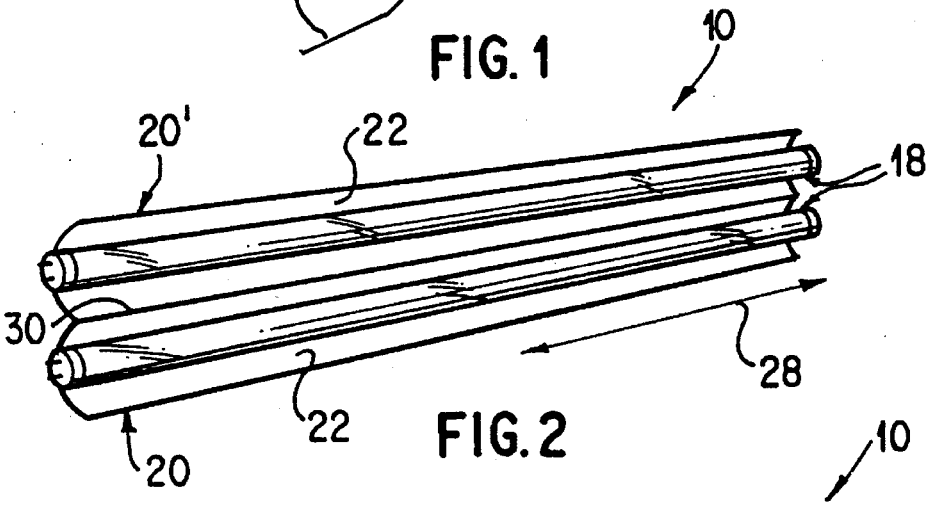
FIG. 2 is a perspective view of the subject invention concept lighting system providing a plurality of longitudinally extending light sources in combination with respective reflector members.

Referring now to FIG. 2, a pair of light mechanisms 18 in the form of fluorescent lamps are used in combination to form a double width light strip for either a lighting fixture or as a sign background, Electrical wiring and related electrical couplings to activate light mechanisms 18 are not shown and are commercially available and not within the scope of the subject invention concept system. Reflectors 20, 20' used in conjunction with fluorescent lamps for light mechanisms 18 extend in elongated direction 28 in a linear manner. Reflectors 20, 20' may be coupled each to the other or placed adjacent along contiguous line connection 30. Where reflectors 20 and 20' provide for a circular envelope contour, lamps or fluorescent bulbs 18 are positionally placed contiguous or adjacent inner surface 22 of reflectors 20 and 20'. Of importance is the fact that fluorescent lamps 18 be positionally located between a center point radius 24 (shown in FIG. 1) and internal reflecting surface 22.

Figure 3:
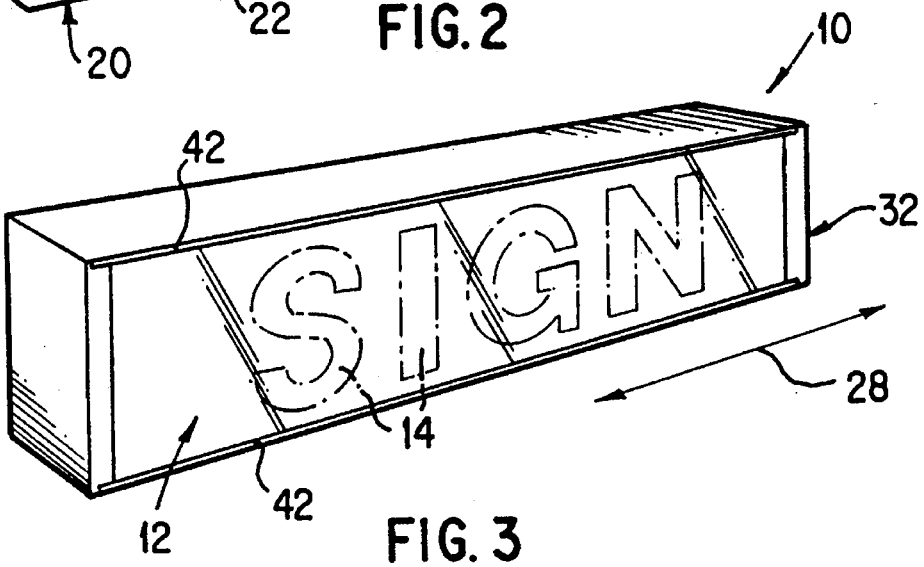
FIG. 3 is a perspective view of the lighting system within a light box showing application for illumination of a sign member.
Figure 4:
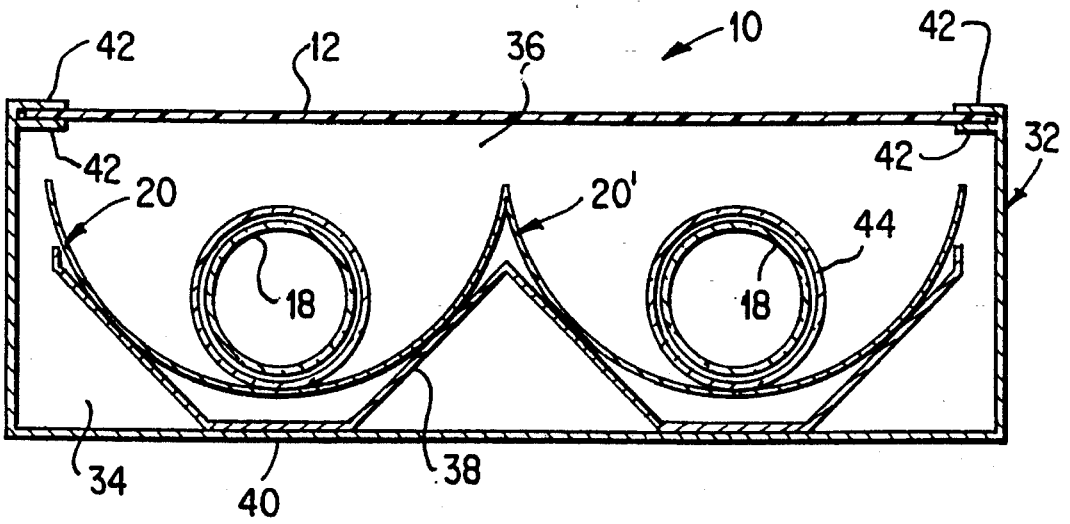
FIG. 4 is a sectional view of the interior of a light box showing a plurality of lighting sources in combination with reflector members.

Lighting system 10 may be incorporated within housing 32 shown in FIGS. 3 and 4 and encompassed therein, Housing 32 may take the form of an overall parallelepiped contour extending in elongated direction 28 having a rear section 34 and a frontal section 36 more clearly shown in FIG. 4. As shown in FIG. 4, reflector members 20, 20' are mounted somewhat in rear housing section 34 through standard reflector support members 38 securely fastened to housing rear wall 40 through bolting, threaded members, adhesive contact or some like mechanism not important to the inventive concept as herein described.

As shown, sign member 12 may be planar in overall contour and includes indicia 14 formed thereon or the indicia 14 may be formed therethrough to provide appropriate visual observation by an external viewer. Sign member 12 is releasably mounted to housing 32 in frontal housing section 36 by insertion of sign member 12 between a pair of guide rails 42 shown in FIG. 4. Guide rails 42 formed on opposing sides of housing 32 provide for an insert guideway within which sign member 12 may be inserted in a sliding fashion to provide an overall closed contour as shown in FIG. 3. The particular manner of insertion of sign member 12 into a positional location as shown in FIGS. 3 and 4 is not important to the inventive concept as herein described with the exception that sign member 12 be releasably securable to housing 32 to provide a stabilized platform.

Sign member 12 may be formed of a clear or colored transparent or translucent material to transmit a constant light band illumination through the clear area of sign member 12. Alternately, sign member 12 may be designed to block the passage of light for indicia 14 while leaving the background area transparent. An opaque vinyl film may be used to block or limit the passage of the visible electromagnetic energy spectrum.

Figure 5:
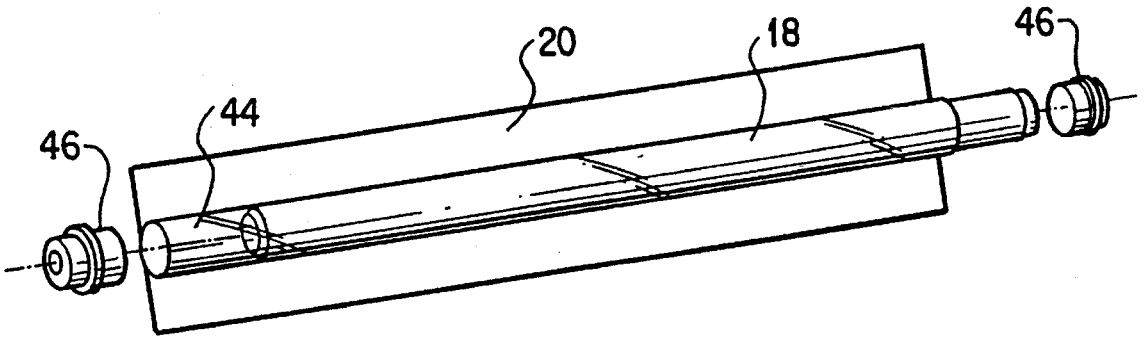
FIG. 5 is a perspective view of the lighting system showing an outer tubular member inserted over an elongated light source.
Figure 6:
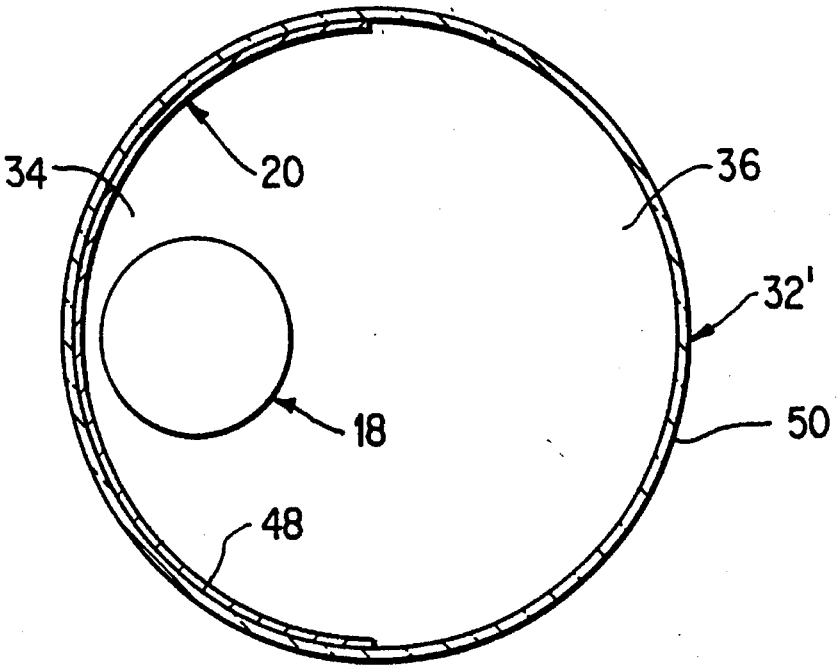
FIG. 6 is an elevational view of the preferred embodiment of the lighting system showing a light source mounted within a transparent or translucent circularly contoured housing member.
Figure 9:
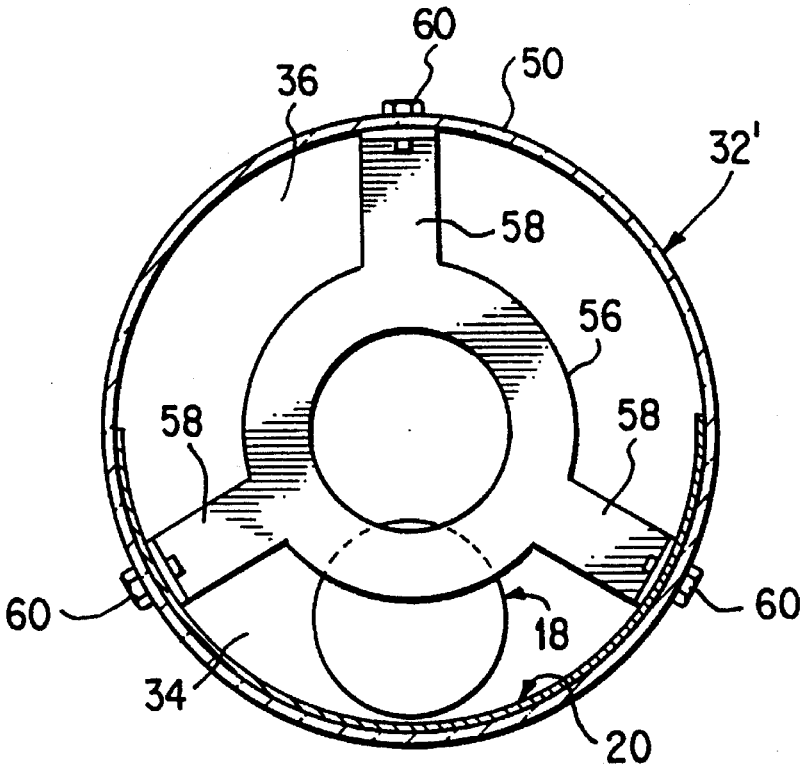
FIG. 9 is an elevational end view of the lighting system shown in FIG. 6 providing one type of end mounting.

As shown in FIG. 5, and incorporated into FIG. 4, transmissive light housing 44 substantially surrounding an outer surface of light mechanism 18 may be provided for transmitting therethrough a predetermined bandwidth of the visible electromagnetic spectrum. Transmissive light housing 44 as shown in FIGS. 4 and 5 may take the form of a tubular housing within which fluorescent tubular light 18 may be inserted. Transmissive light housing 44 may be a filter for providing predetermined coloration for visible light viewed by an observer. Transmissive light housing 44 may be formed of a plastic composition which in particular may be a polycarbonate composition for accepting the heat transfer passing therethrough without deterioration. Additionally, transmissive light housing 44 in the form of a tubular member is formed with a slightly larger diameter than a fluorescent tubular light 18 and end caps 46 are provided for insert into the opposing end portions of transmissive light housing 44. In this manner, the visible light emitted by lighting mechanism 18 may be modified as to color to provide the user with a differing color range passing through sign member 12 for viewing indicia 14. Polycarbonate plastic compositions may be used for transmissive light housings 44 for their physical characteristics of a high clarity, mechanical strength against breakage and durability against high temperature excursions.

Figure 8:
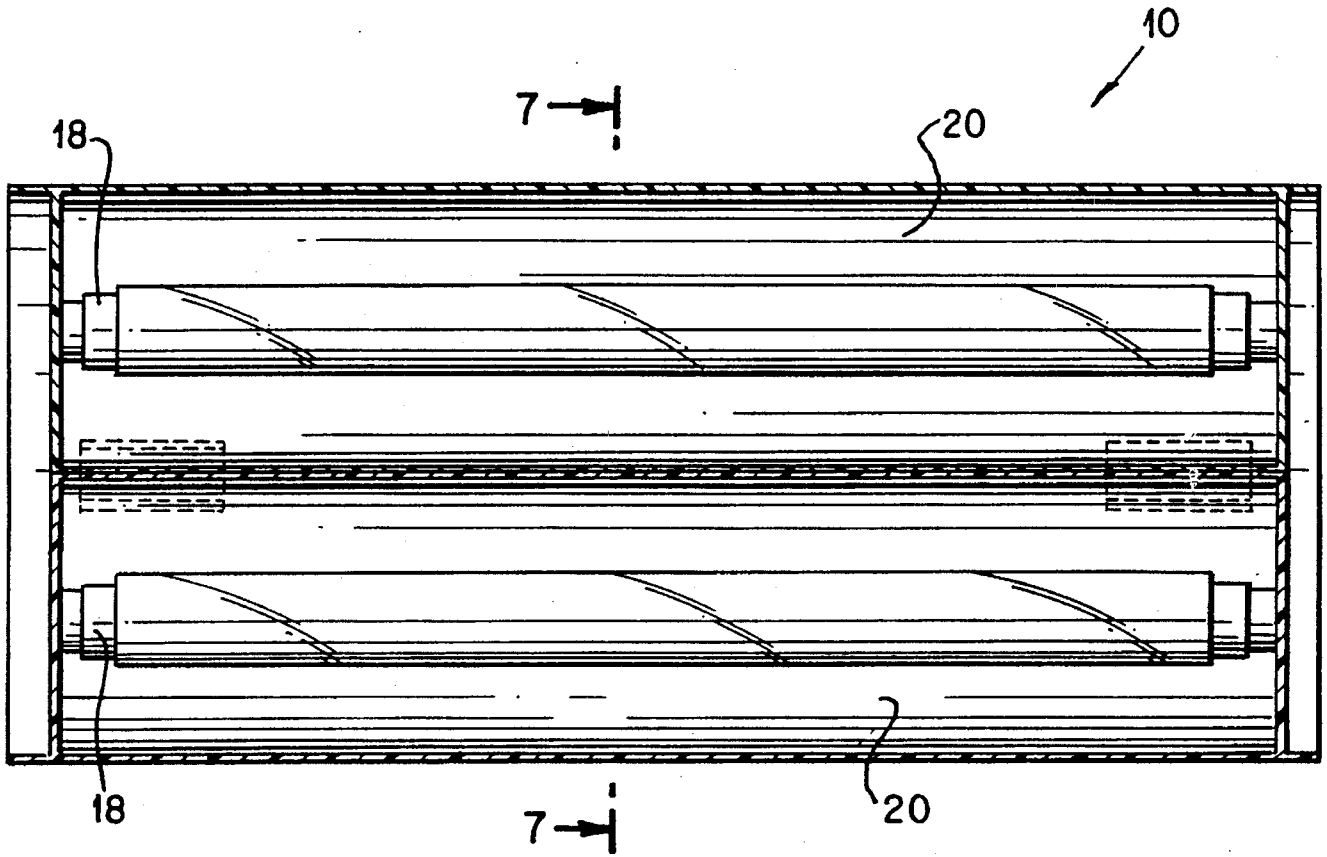
FIG. 8 is a frontal view of the embodiment of the lighting fixture shown in FIG. 7.
Figure 7:
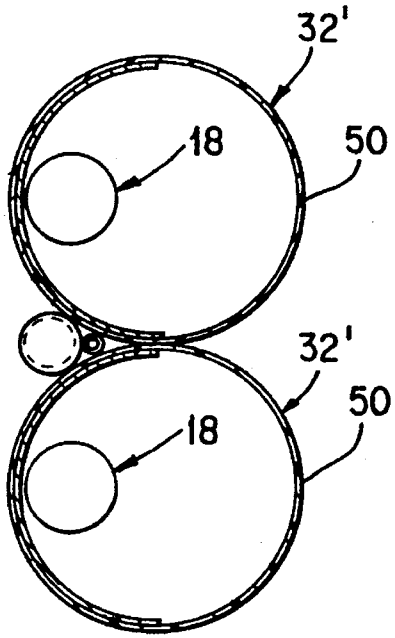
FIG. 7 is an elevational view of the preferred embodiment of the subject invention concept lighting system showing a plurality of light sources with respective reflectors and transparent or translucent housings when used as a lighting fixture.
Figure 10:
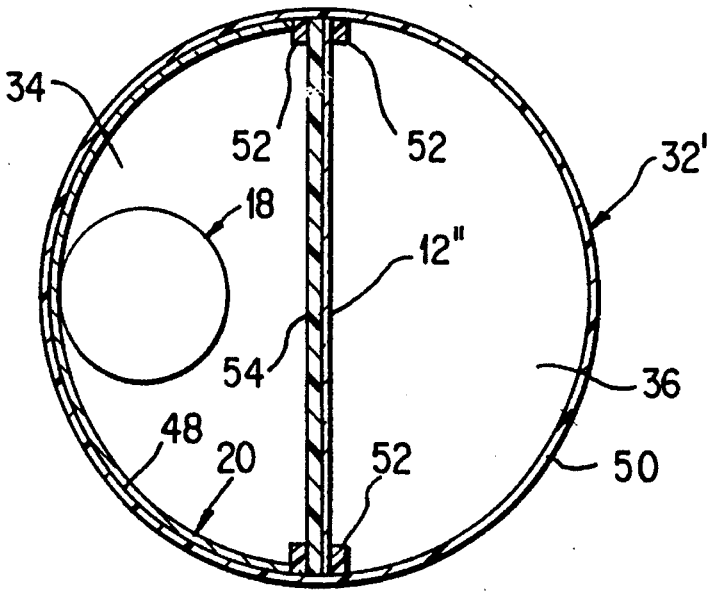
FIG. 10 is an end view of the preferred embodiment of the subject invention concept lighting system having a substantially circular outer housing transparent or translucent housing member incorporating therein a sign member.
Figure 11:
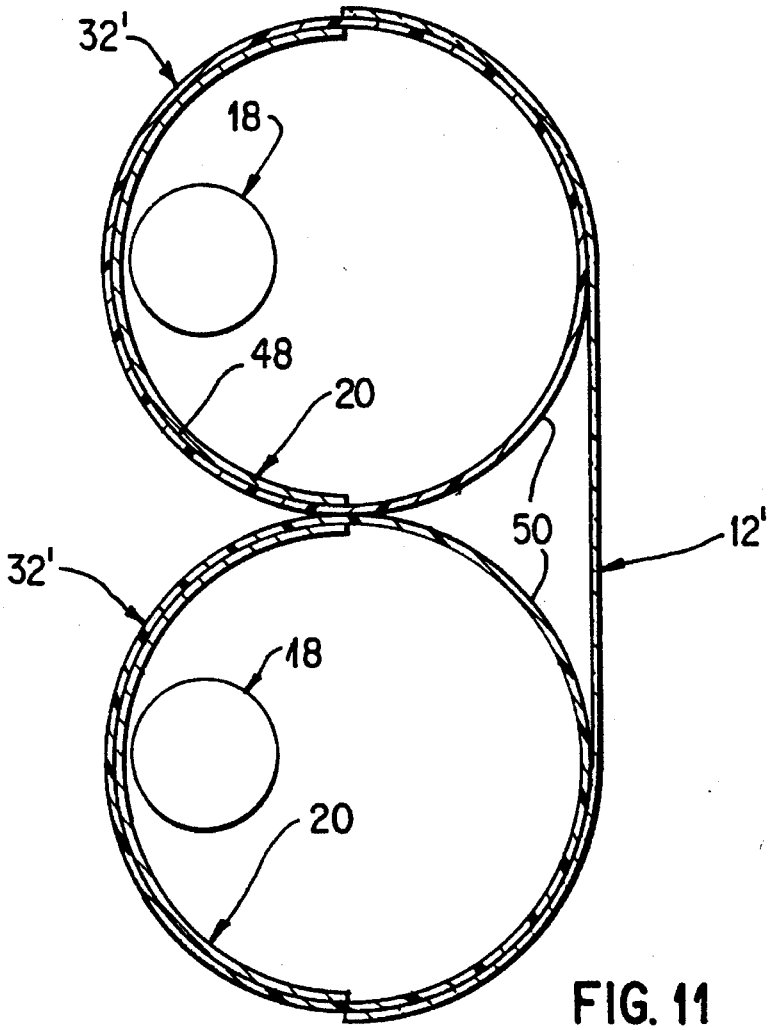
FIG. 11 is an end view of the preferred embodiment of the subject lighting system showing a plurality of light sources with a sign member mounted external to the outer surface of a plurality of transparent or translucent housing members.

Referring now to FIGS. 6–11, there is shown an embodiment of lighting system 18 where system 18 is placed in combination with housing 32' which is substantially circular in cross-sectional contour. With housing 32' being used with a singular lighting mechanism 18 or multiple lighting systems 18 as is shown in FIGS. 8 and 11. Reflector member 20 is secured to inner rear wall 48 of housing 32' in rear section 34. Housing 32' includes frontal section 36 which includes at least a partially light transmissive frontal wall 50. In FIG. 11, sign member 12' may be mounted to at least a portion of the exterior surface of housing frontal wall 50 and is in contiguous contact with a portion thereof. Sign member 12' may be secured to housings 32' through adhesive contact or some like mechanism which would allow release of sign member 12' from the external surface of housing frontal walls 50. Additionally, reflector member 20 is mounted contiguous an inner surface of a rear wall 48 through adhesive securement or some like technique.

As shown in the embodiment provided in FIG. 10, sign member 12" may be releasably secured internal housing 32'. Insertion and removal of sign member 12" from internal housing 32' may be accomplished by extending rail members 52 extending in direction 28 to provide an insert guideway for sign member 12". Insert rail members 52 may be formed in one-piece formation with the housing 32' through an extrusion process. The particular mode and construction of rail members 52 are not important to the inventive concept as herein defined with the exception that such provide a guide pathway or guide insert path for insertion and removal of sign member 12". Additionally, transmissive member 54 may be mounted adjacent sign member 12" for purposes of varying the color or passing therethrough. In this manner, differing bandwidths of the visible electromagnetic spectrum may be provided by the user at his or her discretion.

Light mechanisms 18 may be mounted within housings 32 and 32' in a variety of manners. Standard mountings 56 such as that shown in FIG. 9 may be provided internal to housings 32' and secured through arms 58 and bolts 60 to housing 32' as is shown.

Figure 12:
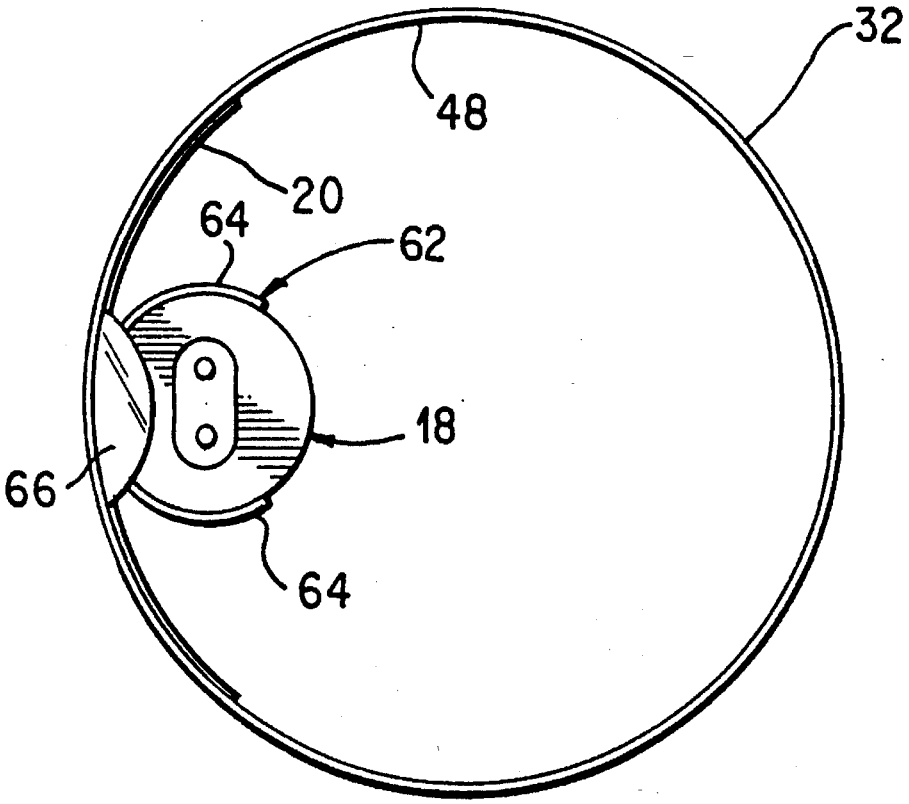
FIG. 12 is an end view of the preferred embodiment of the subject invention concept lighting system showing an end clip for holding the light source within the substantially circularly contoured housing member; and, FIG. 13 is a perspective view partially cut-away of the lighting system showing the clip member of FIG. 12.
Figure 13:
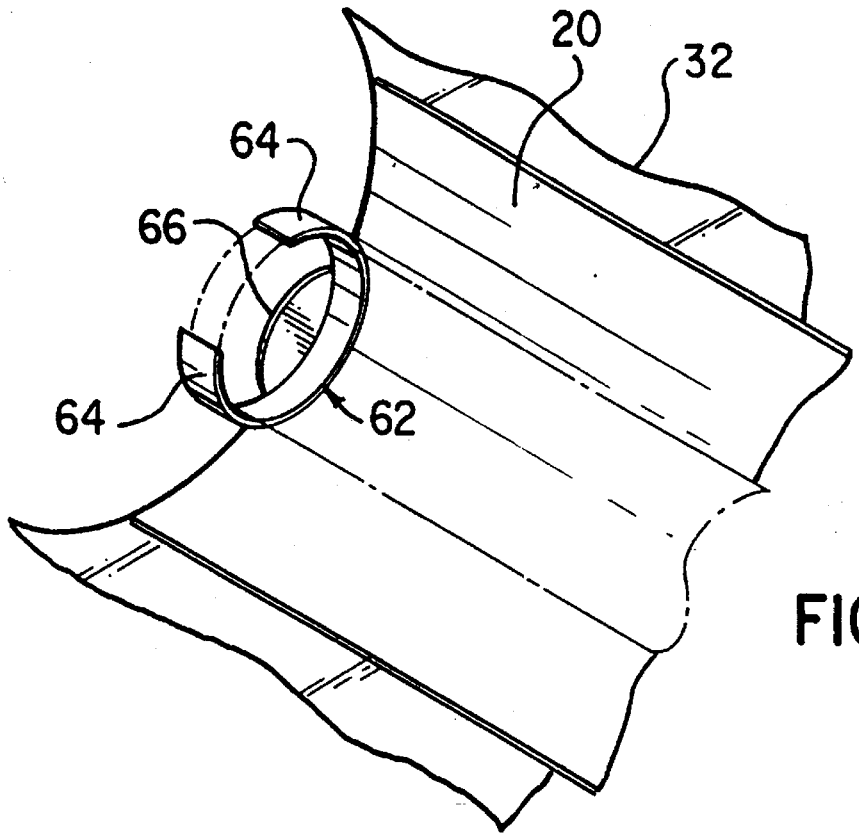

As shown in FIGS. 12 and 13, clip members 62 may be used for releasably mounting light mechanism 18 within housings 32 or 32'. Clip members 62 are mounted on opposing ends of housings 32 and 32' for releasably mounting lighting mechanisms 18 which are flexibly secured to opposing ends of lighting mechanisms 18. Clip members 62 may be fixedly secured to inner rear wall 48 of housings 32 and 32' through adhesive mounting, bolting or some like technique not important to the inventive concept as herein described. Clip members 62 are generally formed of a pair of clip arm members 64 spaced apart from each other as shown in FIG. 12. Clip base members 66 are formed in one-piece formation with clip arm members 64 and base members 66 are secured to inner wall 48 of housings 32 through adhesive attachment or some like means. Clip members 62 are generally formed of a plastic composition which allow insert of lighting mechanisms 18 and allow release therefrom through flexible displacement in a snap fit manner.

Reflectors 20 in general may be formed of a flexible aluminum or silver deposited sheet material which is contoured to the contour of the inner wall of housings 32 and 32' at the discretion of the user. In this manner flexible reflectors 20 may be varied in contour depending upon the contour of the walls of the housings 32 and 32' or the contour of the reflector supports 38 shown in FIG. 4. When adhesive is applied to reflectors 20 a modification of the particular sectional contour of a reflector surface may be provided by adhesion of reflector 20 to the surface of reflector supporter 38 as shown in FIG. 4.

When reflector 20 is provided with a rigid material composition, such reflectors 20 may be bonded to the surface of reflector supporters 38 or fastened by some mechanical Fastening means not important to the invention concept as herein described with the exception that the resulting light emission provide for a plurality of virtual images from lighting mechanism 18.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A lighting system comprising:

(a) light means for emitting electromagnetic radiation within the visible bandwidth, said light means having a predetermined first diameter dimension;

(b) a reflector member having a concavely contoured inner reflective surface, said reflector member inner reflective surface having a substantially semi-circular contour formed by a plurality of linear sections, said light means being positionally located between a focal point of said reflector member and said inner reflective surface for producing a plurality of intersecting virtual images of said light means viewable external said lighting system in an overlapping pattern for providing a substantially wide angle constant illumination pattern, said reflector member having a second diameter dimension approximating three times said predetermined first diameter dimension; and, (c) housing means for substantially encompassing said light means and said reflector member, said housing means defining a rear section for mounting of said reflector member therein.

2. The lighting system as recited in claim 1 where said lighting means includes an elongated light member extending in a predetermined direction, said elongated light member having at least a section thereof defining a substantially cross-sectionally circular contour.

3. The lighting system as recited in claim 2 where said elongated light member is tubular in contour.

4. The lighting system as recited in claim 3 including a transmissive outer tubular member insertable over an outer surface of said elongated light member, said transmissive outer tubular member for transmitting therethrough predetermined bandwidths of said electromagnetic radiation.

5. The lighting system as recited in claim 4 wherein said transmissive outer tubular member is formed of a polycarbonate composition.

6. The lighting system as recited in claim 1 including a sign member having indicia formed thereon and mounted to said housing means, said lighting means being positionally located between said reflector member and said sign member, said indicia being consecutively spaced in a direction concurrent with an extended length direction of said light means.

7. The lighting system as recited in claim 6 where said housing means and said sign member form a substantially parallelepiped contour, said sign member being releasably secured to a frontal section of said housing means.

8. A lighting system comprising:

(a) a housing;

(b) light means fixedly mounted within said housing for emitting electromagnetic radiation within the visible bandwidth; and, (c) a reflector member having a concavely contoured inner reflective surface defining a substantially continuous semi-circular contour, said inner reflective surface contour defining a reflector surface focal point, said light means being fixedly positioned between said reflector member focal point and said inner reflective surface for producing a plurality of intersecting virtual images of said light means viewable external said lighting system in an overlapping pattern for providing a substantially wide angle illumination pattern, said light means having a first diameter and said inner reflective surface defining a second diameter approximating three times said light means first diameter.

* * * * *